United States Patent [19]

Gusfafson et al.

[11] 4,188,025

[45] Feb. 12, 1980

[54] OFFSET SHEET STACKING APPARATUS

[75] Inventors: Gary B. Gusfafson, Hilton; Martin L. Staub, Rochester, both of N.Y.

[73] Assignee: Eastman Kodak Company, Rochester, N.Y.

[21] Appl. No.: 880,416

[22] Filed: Feb. 23, 1978

[51] Int. Cl.[2] ..... B65H 29/22

[52] U.S. Cl. ..... 271/314; 271/184; 271/272; 414/54

[58] Field of Search ..... 271/80, 213, 251, 250, 271/64, 184, 185, 273, 274, 272, 223, 224, 225; 214/6 N, 6 S; 198/624, 436, 437, 457, 412; 93/93 DP, 93 C; 270/58; 226/21-23, 176, 177, 180; 414/54

[56] References Cited

U.S. PATENT DOCUMENTS

| | | | |
|---|---|---|---|
| 2,901,249 | 8/1959 | Dexter et al. | 214/6 N X |
| 3,241,651 | 3/1966 | Colby | 198/437 |
| 3,491,562 | 1/1970 | Kajiwara | 226/21 X |
| 3,994,487 | 11/1976 | Wicklund | 271/80 |
| 4,017,066 | 4/1977 | Lasher et al. | 271/80 |

FOREIGN PATENT DOCUMENTS

| | | | |
|---|---|---|---|
| 1256289 | 12/1971 | United Kingdom | 271/80 |

*Primary Examiner*—Bruce H. Stoner, Jr.
*Attorney, Agent, or Firm*—Raymond L. Owens

[57] ABSTRACT

Apparatus is disclosed for offset stacking two or more sets of sheets produced by a copier or the like. The apparatus includes two rotatable sheet-engagable rollers which form a sheet propelling nip. At least one of the rollers is selectively movable between two positions, so that in the first position the nip imparts a first velocity profile to sheets of the first set to move them seriatim to a first stacking position and in the second position the nip imparts a different velocity profile to sheets of the second set to move them seriatim to a second stacking position offset from the first stacking position.

5 Claims, 16 Drawing Figures

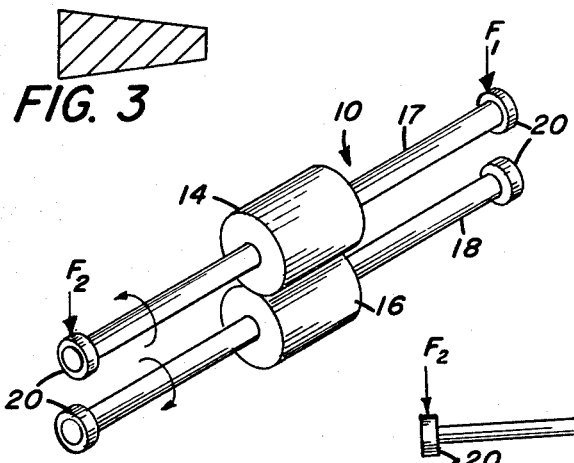
FIG. 3
FIG. 1
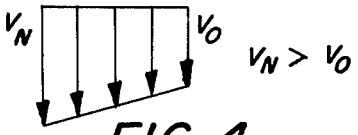
FIG. 4
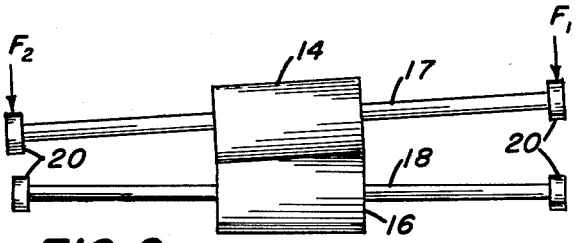
FIG. 2
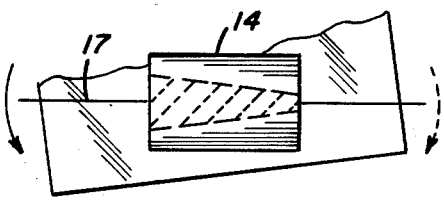
FIG. 5
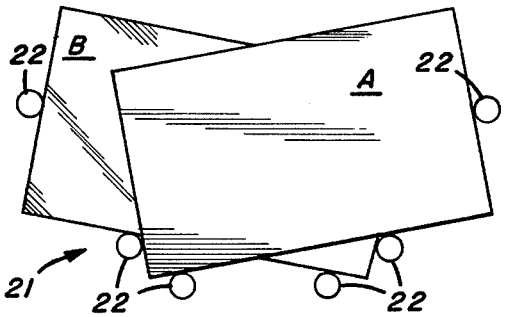
FIG. 6
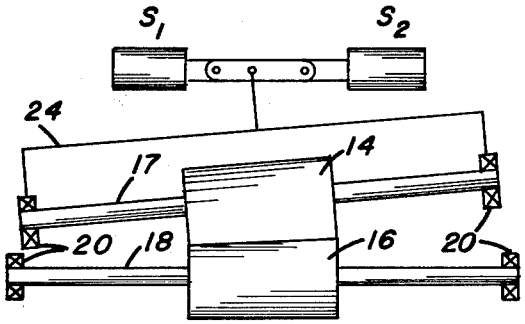
FIG. 7
FIG. 8
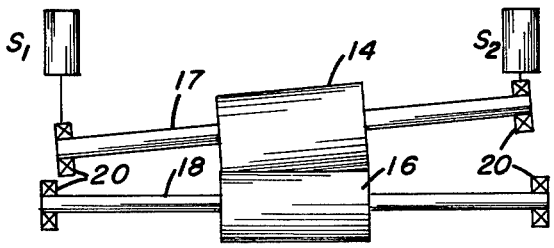

OFFSET SHEET STACKING APPARATUS

CROSS-REFERENCE TO RELATED APPLICATIONS

Reference is made to commonly assigned U.S. Patent Application Ser. No.: 781,395, filed Mar. 25, 1977, now U.S. Pat. No. 4,134,672, entitled: "Finisher", by Leroy E. Burlew et al., the disclosure of which is incorporated by reference herein.

BACKGROUND OF THE INVENTION

1. Field of the Invention

This invention relates to apparatus for offset stacking copy sheet sets in a receptacle.

2. Description of the Prior Art

It is desirable to provide offset copy sheet sets at the output of a copy processing device such as an electrographic copier. For example, U.S. Pat. No. 3,630,607 discloses a document handling apparatus which recirculates the pages of a document to an exposure platen of a xerographic copier which produces copy sheets corresponding to these pages. This apparatus further includes a copy set finisher for assembling the copy sheets into sets in an intermediate tray assembly, and a device for ejecting the sets into an output tray where they are stacked in a staggered, i.e., offset manner. U.S. Pat. Nos. 3,671,094, 3,682,328, 3,685,712, 3,690,537 and 3,709,595 disclose apparatus including a recirculating document feeder, xerographic copier and a copy finisher. These apparatus either assemble copy sheets into booklets for stapling in an intermediate tray before straight stacking the stapled booklets in an output tray or by means of a paddle wheel mechanism, cause individual copy sheets to by-pass the intermediate tray and to be individually offset stacked in sets in the output tray.

Although the various offset stacking devices disclosed in the aforementioned patents may be appropriate for their intended uses, they are all relatively complex and on occasion suffer from problems such as paper jamming and misfeeds.

The present invention is concerned with selectively applying different velocity profiles to copy sheets to cause them to be delivered into offset stacks of copy sheet sets in a receiving receptacle. U.S. Pat. No. 3,929,327 discloses a drive roller or conical configuration which aligns copy sheets. It does not disclose or even mention offset stacking of copy sheet sets. U.S. Pat. No. 3,175,824 depicts frusto-conical or beveled gear rollers which skew sheets but do not offset stack copy sheet sets. In the paper box art, machines are well-known which provide for turning and also for stacking carton blanks. See for example, U.S. Pat. Nos. 2,761,363 and 3,758,104.

SUMMARY OF THE INVENTION

In accordance with this invention two rotatable sheet-engaging rollers form a nip for propelling sheets to either of two different stacking positions to form offset sets. At least one of the rollers is movable between two positions. In the first position, the nip imparts a first velocity profile to the sheets of the first set to move them seriatim to a first stacking position. In the second position, the nip imparts a second velocity profile to the sheets of the second set to move them seriatim to a second stacking position offset from the first stacking position.

BRIEF DESCRIPTION OF THE DRAWINGS

In the detailed description of the various embodiments of the invention presented below, reference is made to the accompanying drawings, in which:

FIG. 1 is a diagrammatic perspective of apparatus in accordance with the invention in which two rotatable rollers form a sheet propelling nip;

FIG. 2 is a diagrammatic front view of the rollers shown in FIG. 1, with the top roller being tilted to the left;

FIG. 3 depicts a non-uniform nip contact area when the rollers are in the position shown in FIG. 2;

FIG. 4 sets forth a graph which shows a non-uniform velocity profile imparted to copy sheets by the FIG. 3 nip contact area;

FIG. 5 is a diagrammatic top view which depicts a copy sheet being turned by the rollers when in the FIG. 2 position;

FIG. 6 is a diagrammatic top view showing two offset copy sheet sets in a receiving receptacle for the FIG. 1 embodiment;

FIGS. 7, 8, & 9 depict different mechanism for tilting the top roller shown in FIG. 1;

DETAILED DESCRIPTION OF THE PREFERRED EMBODIMENT

Figure 9:
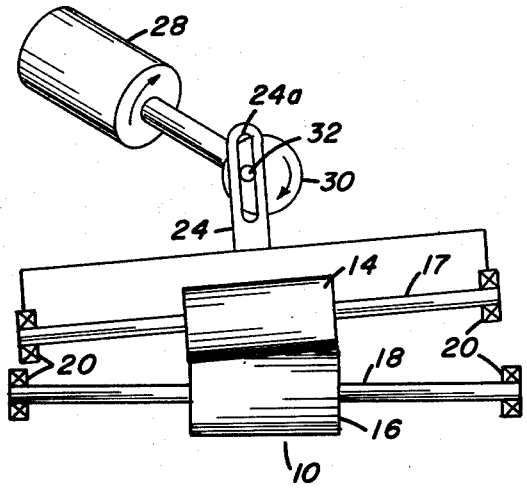

It will be understood that the present invention may be used with apparatus having a feeder, a copier and a copy sheet finisher. An example of such apparatus is disclosed in the patent application referred to in the section of this specification entitled: "Cross-Reference To Related Applications". It is to be understood, however, that the present invention could be used with equal facility and advantage in other copy processing or sheet material handling devices.

FIG. 1 shows an apparatus with a nip-forming roller assembly 10 having cylindrical top and bottom rollers 14 and 16, which engage to form a sheet propelling nip. The rollers are identical in construction and include rotatable shafts 17 and 18, respectively, which are preferably made of steel. Molded to each of these shafts is a layer of compliant material such as rubber or neoprene. For a specific example, the diameter of the shaft could be five-eights ($\frac{5}{8}$) of an inch whereas the roller diameter could be one and three-eights ($1\frac{3}{8}$) inches. The hardness of the compliant material may be advantageously selected to be in a range of about 50–90 on the A scale of the "SHORE DUROMETER". The top roller 14 is mounted for movement in response to an inbalance in the forces $F_1$ and $F_2$ applied to the bearing 20 of the top shaft 17.

As shown in FIG. 2 the roller 14, under the influence of force $F_2$ (being greater than $F_1$), is moved or tilted to the left. Since the nip pressure is greater at the left than at the right, the deformation of the compliant surfaces of rollers 14 and 16 forms a nonuniform contact area at the nip; this contact area, is illustrated in FIG. 3. This nonuniform nip contact area causes a nonuniform velocity profile, illustrated in FIG. 4, to be imparted to a sheet propelled from the nip. A nonuniform velocity profile means that at least two different points on a copy sheet will have substantially different velocities. The velocity $V_n$ of any point on the left hand edge of a copy sheet is greater than the velocity $V_o$ of any point on the opposite edge. Copy sheets traveling through the nip roller assembly are propelled under the influence of the nonuniform nip contact area, as depicted in FIG. 5. As illustrated in FIG. 6, the nonuniform velocity profile imparted to a copy sheet causes it to move along a arcuate path (see the "solid line" arrow) into a stack A in a receptacle 21. The receptacle 21 of FIG. 6 includes a number of sheet-engaging pins 22 which are fixed to a bottom plate, not shown. These pins define two offset stacking positions. Sheets delivered to the first stacking position form the stack A, and sheets delivered to the second stacking position form a stack B.

After the copy sheets of the first set are fed to stack A, the roller 14 is then tilted to the right under the influence of force $F_1$ (being greater than $F_2$), and the next copy sheet of a second set is propelled from the nip and moves along another arcuate path (see the dotted line arrow) until it is delivered to stack B. Thus at the completion of both copy sets being fed to the receptacle 21, the first copy sheet set is in stack A and the second copy sheet set is in stack B, which is offset from stack A.

Several alternative arrangements for applying forces $F_1$ and $F_2$ which tilt the roller 14 are illustrated in FIGS. 7 through 9. In FIG. 7 two opposing solenoids S1 and S2 operate when energized on a yoke 24 and cause the roller 14 to tilt left or right respectively depending upon which soleonid is energized. If both solenoids are simultaneously de-energized, the roller 14 is positioned in a neutral position, and a uniform rectangular nip contact area is formed. In this neutral position, sheets are fed in a straight line to another stacking position, not shown.

FIG. 8 is another arrangement wherein solenoids S1 and S2, operate directly on ends of the nip roller shaft 17 to apply the forces F1 and F2, respectively.

FIG. 9 is still another arrangement for positioning the shaft 17 and includes a motor 28 which, when energized, drives a disk 30 with an offset pin 32 causing an eccentric motion of a yoke 24 as the pin 32 travels in a slot **24*a* formed in the yoke 24. This type of yoke is often referred to as a scotch yoke. The yoke 24, shown only schematically, is fixed to the bearings 20. When the motor is energized it rotates in a clockwise direction and the pin 32 rides in the slot 24*a*. When the pin 32 reaches the right mid-point of the slot 24*a*, the shaft 17 will be tilted to the right and the motor is de-energized. With this scotch yoke arrangement, the roller 14 will not move to a neutral position when the motor 28 is de-energized, but remains in the position where the scotch yoke positioned it. When it is desired to feed sheets to a second stacking position, the motor 28 is again energized and the pin 32 rides in the slot 24*a* until it engages the left midpoint of the slot. At this time the shaft 17 is tilted to the left as shown in FIG. 9. It should be noted that, when the pin 32 is at the top or the bottom position in the slot 24*a***, the rollers are in neutral position (i.e. form a uniform nip contact area).

Figure 10:
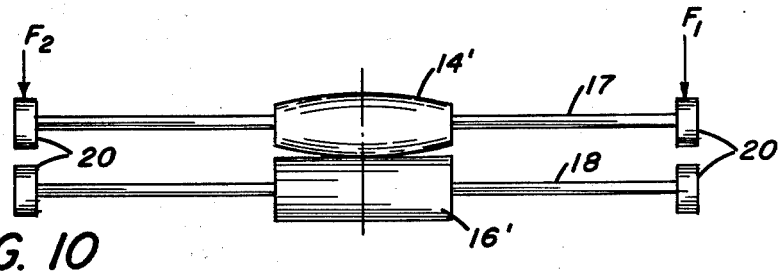
FIGS. 10, 11 and 12 are diagrammatic views of yet another embodiment of the invention wherein the top roller is a crowned roller and the bottom roller is a cylindrical roller.
Figure 11:
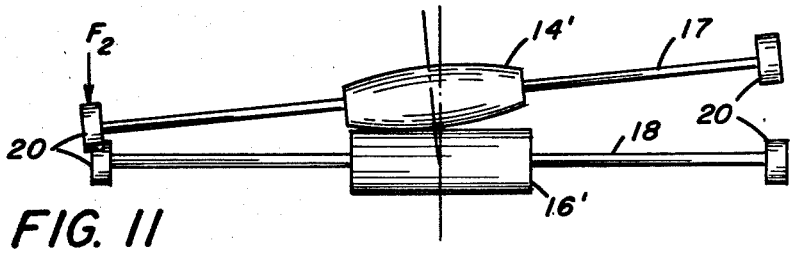
Figure 12:
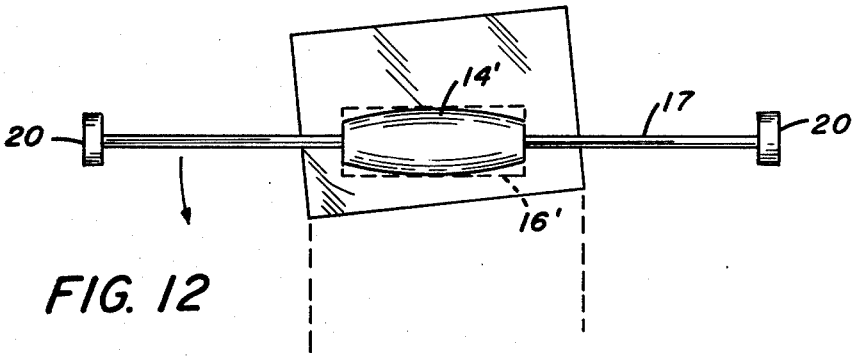

Another embodiment of this invention is depicted in FIGS. 10 through 12. The basic nip roller assembly configuration is quite similar to that shown in FIG. 1 and many of the same numerals will be used for clarity of illustration. Both the rollers 14' and 16' are formed of a compliant material such as rubber. In this embodiment, the movable roller 14, is crowned, whereas the roller 16' is a conventional cylindrical-type nip roller. When the crowned roller 14' is tilted, under the influence of force $F_2$ (being greater than $F_1$), a nonuniform nip contact area is produced. A copy sheet is moved along an arcuate path similar to that shown by the solid arrow in FIG. 12. The skewed copy sheet is then delivered to the receptacle 21 where it is positioned in stack A such as shown in FIG. 6. Subsequently, the roller 14' may be tilted under the influence of force $F_1$ (being greater than $F_1$), causing a copy sheet to rotate in the opposite direction and move to the stack B, which is offset from stack A. It will be understood that any one of the arrangements shown in FIGS. 7 and 9 may be used for applying the forces $F_1$ and $F_2$.

Figure 13:
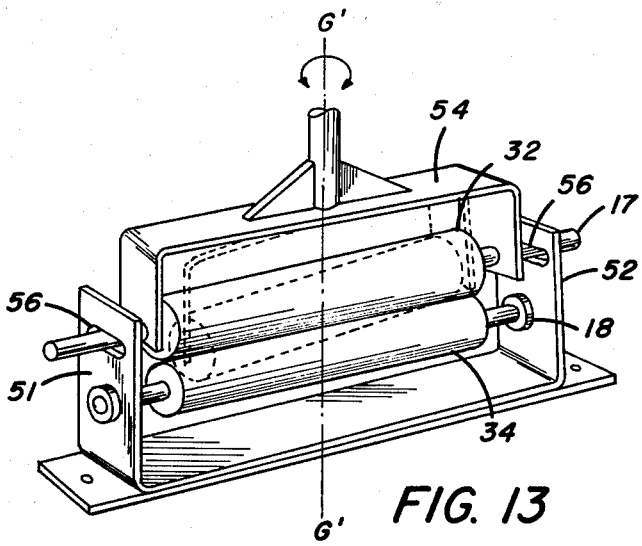
FIG. 13 is a diagrammatic perspective of still another embodiment of the invention, including two rollers, wherein the top roller is rotatable about axis G'—G' to three different positions to change the nip contact area.
Figure 14:
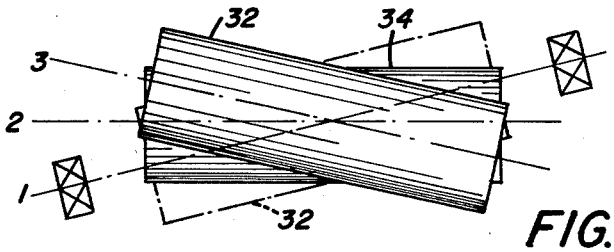
FIG. 14 is a diagrammatic top view of the embodiment of FIG. 13 showing more clearly its three positions, along with a velocity profile imparted to copy sheets for the first such position.
Figure 14:
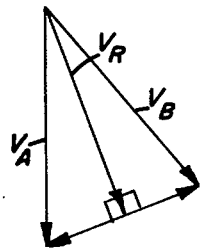
Figure 15:
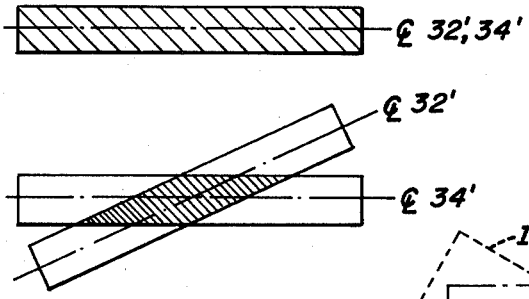
FIG. 15 is a diagrammatic representation of nip contact areas formed by the rollers of FIG. 13 in their second and first positions respectively.
Figure 16:
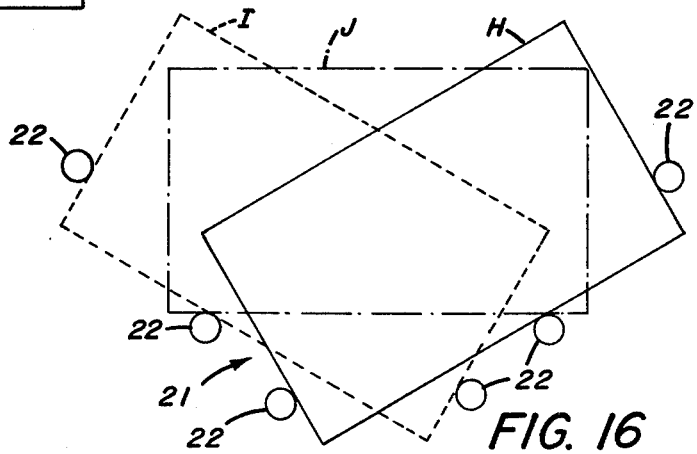
FIG. 16 is a diagrammatic top view of three offset copy sheet sets in a receiving receptacle for the FIG. 13 embodiment.

In FIG. 13 another nip roller assembly is shown to include upper and lower rollers 32 and 34, respectively. The upper roller 32 is rotatably mounted about an axis G–G' which is perpendicular to the axes of both rollers 32 and 34, which axes are respectively labeled 32' and 34' in FIG. 15. As shown, the roller 34 is journalled in side walls 51 and 52, respectively. The roller 32 is mounted in an anvil-type bracket 54. The ends of the roller 34 are positioned in slots 56 formed in the end walls 51 and 52. By rotating the anvil 59 about axis G'G' the nip can assume one of the three positions. The rollers 32 and 34 are made of a compliant material such as rubber. When the rollers 32 and 34 are in position one ("1") of FIG. 14, the nip pressure forms a contact area shown by the bottom nip contact area illustration of FIG. 15. This nip contact area imparts a uniform velocity profile shown as a vector $V_R$, to a copy sheet. The vector $V_R$ is a resultant of velocity vectors $V_A$ and $V_B$ respectively applied to any given point on a copy sheet by the nip. The copy sheet is moved along a straight-line path defined by the vector $V_R$ without rotation and is advanced into receptacle 21 where it is positioned in stack H, indicated by full lines. See FIG. 16. With the nip roller assembly in position three ("3"), a delivered sheet is delivered to stack I, indicated by short dashes. In position two "2", the neutral position, the nip rollers form a rectangular contact area shown by the top nip contact area illustration of FIG. 15 and move a sheet in the same direction as it is moving when received at the nip. In such a situation, a copy sheet will be delivered to stack J, indicated by long dashes.

The invention has been described with reference to various embodiments thereof, but it will be understood that variations and modifications can be effected within the spirit and scope of the invention.

We claim:

1. Apparatus for offset stacking one sheet relative to a second sheet, comprising:

means for seriatim feeding said sheets including a pair of rotatable rollers mounted to form a sheet propelling nip, said rollers being positionable relative to each other such that in a first position they define a first nonuniform nip contact area and in a second position a second nip contact area which respectively impart different velocity profiles to sheets in the nip; and means for selectively moving at least one of said rollers between said two positions to form said first and second nip contact areas, so that in the first position the nip imparts a nonuniform velocity profile to one sheet to move it to a first stacking position, and in the second position the nip imparts a different velocity profile to a second sheet to move it to a second stacking position which is offset from said first stacking position.

2. The invention as set forth in claim 1 wherein at least one of said rollers is cylindrical.

3. The invention as set forth in claim 2 wherein one of said rollers is crowned.

4. A method for offset stacking in a receptacle at least two sets of sheets which are delivered to said receptacle by two rollers forming a sheet propelling nip, comprising the steps of:

(a) positioning at least one of such rollers to form a first nonuniform nip contact area with the other of such rollers which imparts a first nonuniform velocity profile to sheets of a first set to propel such sheets seriatim along a first path to a first stacking position in said receptacle; and (b) positioning at least one of such rollers to form a second nip contact area with the other of such rollers which imparts a second velocity profile to sheets of a second set to propel such sheets seriatim along a second path to a second stacking position in said receptacle offset from said first stacking position.

5. The invention as set forth in claim 1 wherein said second nip contact area is nonuniform and imparts a nonuniform velocity profile to a sheet in the nip to move it to the second stacking position.

* * * * *